US012624704B2

(12) United States Patent
Rasmussen et al.

(10) Patent No.: US 12,624,704 B2
(45) Date of Patent: May 12, 2026

(54) AIR VENTING

(71) Applicant: Grundfos Holding A/S, Bjerringbro (DK)

(72) Inventors: Bjarne Dindler Rasmussen, Bjerringbro (DK); Lars Sund Mortensen, Bjerringbro (DK); Ole Bech-Lisberg, Bjerringbro (DK); Mathias Skødt Larsen, Bjerringbro (DK)

(73) Assignee: Grundfos Holding A/S, Bjerringbro (DK)

( * ) Notice: Subject to any disclaimer, the term of this patent is extended or adjusted under 35 U.S.C. 154(b) by 424 days.

(21) Appl. No.: 18/469,332

(22) Filed: Sep. 18, 2023

(65) Prior Publication Data

US 2024/0102478 A1 Mar. 28, 2024

(30) Foreign Application Priority Data

Sep. 22, 2022 (DK) ..... PA 2022 70461

(51) Int. Cl.
*F04D 27/00* (2006.01)
*F04B 13/00* (2006.01)
(Continued)

(52) U.S. Cl.
CPC ..... *F04D 27/004* (2013.01); *F04B 13/00* (2013.01); *F04B 49/20* (2013.01); *F04B 53/06* (2013.01); *F04B 2205/503* (2013.01)

(58) Field of Classification Search
CPC .... F04D 27/004; F04D 9/001; F04D 15/0066; F04B 13/00; F04B 49/20; F04B 53/06;
(Continued)

(56) References Cited

U.S. PATENT DOCUMENTS 996,129 A 6/1911 Peck
4,027,691 A * 6/1977 Roffelsen ..... F16L 55/07 96/204
(Continued)

FOREIGN PATENT DOCUMENTS

DE 102004021988 A1 11/2005
EP 0689012 A1 12/1995
(Continued)

OTHER PUBLICATIONS

Extended European Search Report; European Patent Office; European Patent Application No. 23198813.0; Feb. 6, 2024; 5 pages.
(Continued)

*Primary Examiner* — Terry K Cecil
(74) *Attorney, Agent, or Firm* — Taft Stettinius & Hollister LLP

(57) ABSTRACT

The invention relates in a first aspect to method of venting air out of a closed fluid system comprising a number of inter connected pipes configured for flow of a fluid, a variable speed pump configured for controlling the volume flow of fluid in said fluid system and an air venting device configured to let air out from the fluid system, the method comprising operating said pump in at least three phases.

20 Claims, 2 Drawing Sheets

(51) Int. Cl.
*F04B 49/20* (2006.01)
*F04B 53/06* (2006.01)

(58) Field of Classification Search
CPC ..... F04B 2205/503; F24D 19/083; F24D 19/1012; F24H 15/34
See application file for complete search history.

(56) References Cited

U.S. PATENT DOCUMENTS

| | | | | |
|---|---|---|---|---|
| 4,718,922 | A * | 1/1988 | Roffelsen | F24D 19/083 237/66 |
| 8,540,799 | B2 * | 9/2013 | Mueller | F04B 53/06 96/155 |
| 2011/0247490 | A1 | 10/2011 | Mueller et al. | |

FOREIGN PATENT DOCUMENTS

| | | | |
|---|---|---|---|
| EP | 1593916 | A2 | 11/2005 |
| EP | 2466145 | A2 | 6/2012 |
| EP | 2918923 | A1 | 9/2015 |
| EP | 4015827 | A1 | 6/2022 |

OTHER PUBLICATIONS

First Examination Report and Search Report; Danish Patent and Trademark Office; Danish Patent Application No. PA 2022 70461; Feb. 3, 2023; 6 pages.

* cited by examiner

AIR VENTING

CROSS-REFERENCE TO RELATED APPLICATIONS

This application is a U.S. Nonprovisional Application of Danish Patent Application No. PA 2022 70461 filed on Sep. 22, 2022, which is incorporated herein by reference in its entirety.

FIELD OF THE INVENTION

The invention relates in a first aspect to method of venting air out of a closed fluid system comprising a number of inter connected pipes configured for flow of a fluid, a variable speed pump configured for controlling the volume flow of fluid in said fluid system and an air venting device configured to let air out from the fluid system, the method comprising operating said pump in at least three phases.

BACKGROUND OF THE INVENTION

Many heating and cooling systems utilizes a medium (a fluid) such as water for transport of heat. In such system the medium is circulated in pipes forming a distribution network distributing the medium to various heat exchanges such as radiators, floor heating pipes. In heating system the medium is heated by a heat source, such as a boiler, heat pump or solar panel. To effectively circulate the medium, such systems are equipped with one or more pump which circulate the medium.

Quite often systems suffer from the drawback of air in the medium. Problems relating to air in such systems are numerous and may be one or more of irritating noise generating, lowering of a system's efficiency to transport heat (due to air having a lower heat capacity than water) and/or malfunction of the system in the sense that the air present prevents an effective circulation of the medium in at least some branches of the system.

Air may enter into a system by different causes. For instance, when installing a system for the first time, there will, of course be air in the piping that needs to be removed. Further, during service of a system, the medium is often drained in at least a part system for a later refilling after service. Such operations also introduces air into the system. In addition, the medium when introduced often contains air which over time will be released from the water forming air pocket.

In some situations, a system is pressurized to an above atmospheric pressure and although a system is constructed with great care with regards to being water tight, it is not uncommon that small amount of water is leaking e.g. at a fitting connecting pipes or connecting a sensor. Although this seldom is a larger issue as such, such leaks demands a top-up of water whereby air may be introduced via this top-up. In some instances, the system may even comprise an automatic top-up. In an addition, air may leak into a system e.g. through seals e.g. due to pressure fluctuations in the system.

To avoid presence of air, systems are often equipped with an air-venting device allowing air to escape the system during filling and operation. While such air-venting device may at least potentially mitigate problems relating to the presence of air, it is quite often so that manually venting is needed e.g. at a radiator as the air-venting device and the layout of the system prevents air from leaving the system through the air-venting device.

Needleless to say, manually venting is undesired as it often involves that a service technician to manually detect the presence of air and its location, and design a way to remove the water. While this can, of course, be carried out manually the process is often time and costs consuming and needs to await that the service technician is available, during which time the system is either not operating or at least operates in a less desired way.

Thus, an improved manner of venting a system is desirable.

OBJECT OF THE INVENTION

It is an object of the invention to provide a more efficient method and device for venting air out of a fluid system. It is a further object of the present invention to provide an alternative to the prior art.

SUMMARY OF THE INVENTION

The invention relates in a first aspect to method of venting air out of a closed fluid system comprising a number of inter connected pipes configured for flow of a fluid, a variable speed pump configured for controlling the volume flow of fluid in said fluid system and an air venting device configured to let air out from the fluid system, the method comprising operating said pump in at least three phases, wherein

- in a first phase, said pump is operated to provide a number of first flow pulses in said fluid system each having a pulse width being shorter than a first pulse width,
- in a second phase, during which air, if present in said fluid, is detected, and
- in a third phase, said pump is operated to provide a number of third flow pulses in said fluid system each having a pulse width being longer than said first pulse width.

Preferred embodiments of the invention provides inter alia the effect of providing an efficient venting air out of a closed fluid system, by utilizing the first and third phases. As will become apparent from the following detailed description, the first phase has a high tendency to loosen air accumulations whereas the third phase is designed to transport air around in the closed fluid system, typically towards an air-venting device. The second phase is typically use to evaluate whether air is present or not in the closed fluid system which may be used as an indicator or decision marker pertaining to whether or not the method is to be carried out.

An air venting device may be placed at numerous positions within the closed fluid system, where some of the positions may provide a better air venting than others, when the closed fluid system is operated without carrying out an embodiment of air venting method. Experiments carried out with preferred embodiments according to the first aspect has shown that air venting is efficient in general with regards to various positions of the air venting and is particular useful when the air venting device is positioned in a less optimal position. This provides a greater design freedom, as the air venting device does not as such may need to be positioned in a most optimal position and may be positioned where it can be fitted.

As the method according to preferred embodiments may be implemented by controlling the pump, such preferred methods may be implemented to operate in an automated manner either fully automated or semi-automated where for instance a user initiates and/or ends the method.

In preferred embodiments, the fluid flowing in the closed fluid system is water preferably being tap water or treated water. Treated water may be water to which one or more additives are added such as one or more viscosity reducing additives and/or corrosion inhibiting additives.

Terms used herein are used in a manner being ordinary to a skilled person. Some of the used terms are elucidated here below.

Closed fluid system is used to reference a system comprising a number of interconnected pipes and wherein a fluid is recirculated. Closed does not necessarily refers to that a closable opening may not be present as a closed fluid system typically comprising one or more venting devices and valves allowing for discharging fluid from the system as well as introducing fluid into the fluid system.

Venting device is use to reference a device configured to allow air to be vented out from the fluid system. A venting device may in some embodiments be an automated venting device, such as a device comprising a float which controls opening and closing of a venting valve through which air is vented out.

Flow pulse is used to reference a flow situation where the volume flow is increased and subsequently decreased. A flow pulse typically spans a period starting from where the flow is increased and ending after the decrease has ended. A system typically has a hydraulic response time, which typically is the time it takes before the volume flow settles in response to an increase or decrease in rotational speed of the pump for the fluid. The hydraulic response is typically larger than zero seconds. In this connection, a flow pulse may preferably be a flow situation where the rotational speed is increased and subsequently decreased so that the flow pulse typically spans a time period starting from where the rotational speed of the pump is increased and ending when the decrease in rotational speed has ended.

Pulse width is used to reference the elapsed time between the point in time where the volume flow begins to increase and the point in time where the decrease of volume flow begins. As for the flow pulse, the pulse width may preferably be implemented so that the pulse width typically spans the elapsed time between the point in time where the rotational speed of the pump begins to increase and the point in time where a decrease of rotational speed begins.

The invention relates in a second aspect to a closed fluid system comprising a number of inter connected pipes configured for flow of a fluid, a variable speed pump configured for controlling the volume flow of fluid in said fluid system and an air venting device configured to let air out from the fluid system, wherein said closed fluid system comprising a processor, wherein the processor is configured to carry out a method according to the first aspect.

BRIEF DESCRIPTION OF THE FIGURES

The present invention and in particular preferred embodiments thereof will now be described in more detail with reference to the accompanying figures. The figures show ways of implementing the present invention and are not to be construed as being limiting to other possible embodiments falling within the scope of the attached claim set.

DETAILED DESCRIPTION OF PREFERRED EMBODIMENTS

Figure 1:
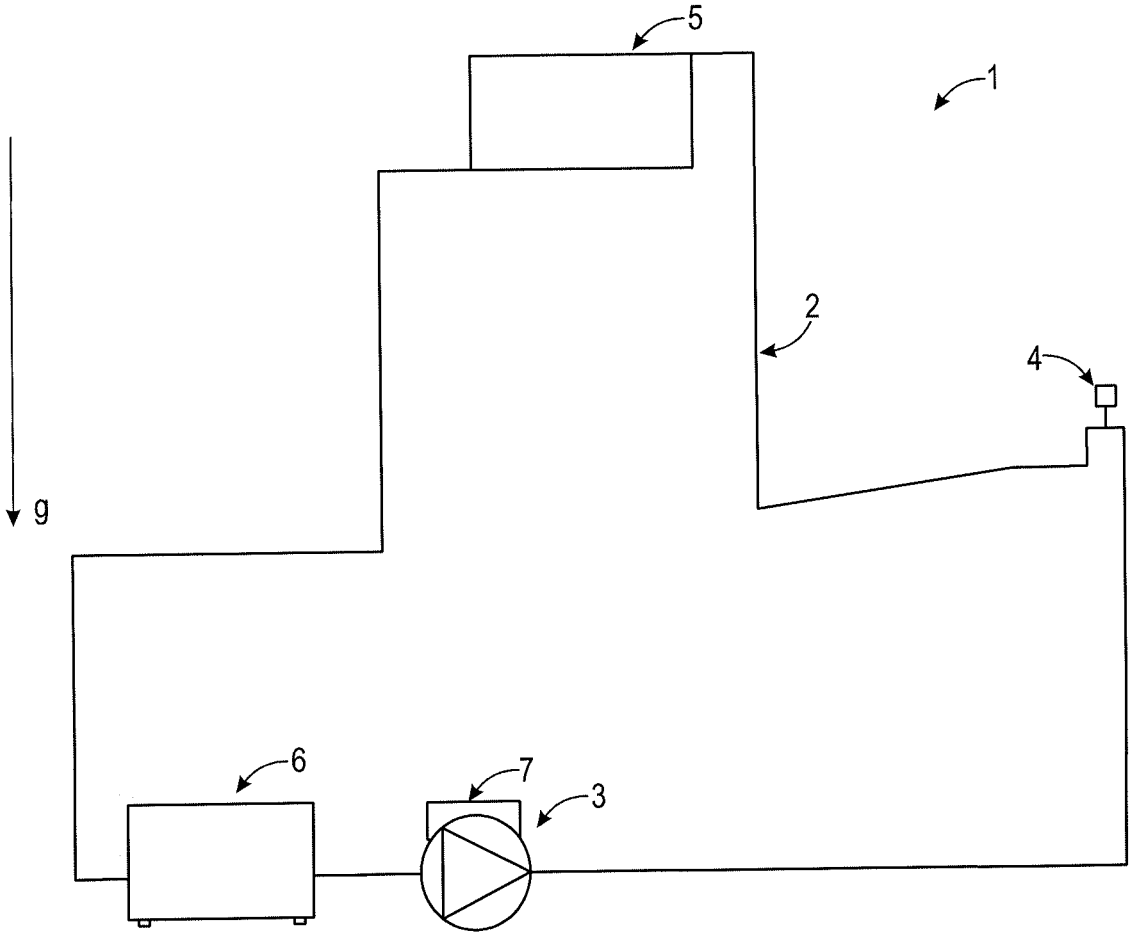
FIG. 1 is a schematically illustration of a closed fluid system.

Reference is made to FIG. 1 schematically illustrating an embodiment of closed fluid system. It is noted that the closed fluid system is illustrated to disclose principles according preferred embodiments of methods according to the invention and in many practical implementations other parts may be comprised in the closed fluid system, such as a water based floor heating subsystem, and more radiators may be included. In addition, the method according to the present invention is not limited to heating purposes and a closed fluid system may not comprise a boiler 6 or radiators 5.

The closed fluid system 1 illustrated in FIG. 1 is a closed fluid system extending horizontally as well as vertically illustrated by the gravity arrows g. However, although most closed fluid system often extends both in vertical and horizontal direction, the invention is not limited to such systems.

In preferred embodiments, the invention relates to a method of venting air out of a closed fluid system 1, such as in a closed fluid system 1 disclosed in FIG. 1. A closed fluid system according to preferred embodiments of the invention comprise a number of inter connected pipes 2 configured for flow of a fluid. It is to be observed that "inter connected" does imply that for instance a flow path involving a bend must be provided by assembling pieces of pipes by fittings as such a flow path may be provided by a bend pipe. Interconnected typically refers to the situation that the pipes together with other components of the closed fluid system provides a flow path in which the fluid recirculates.

The flow of fluid is provided by a variable speed pump 3. A Preferred pump 3 in connection with the present invention is typically an electrically operated pump 3 comprising an electrical circuit connected to an electrical motor driving the impeller, which electrical circuit is configured to set the rotational speed of the electrical motor and thereby the impeller to a desired RPM. By having a variable speed option, the pump 3 is configured for controlling the volume flow of fluid in said fluid system 1.

To allow air from being vented out from the closed fluid system 1, an air venting device 4 configured to let air out from the fluid system is provided. In preferred embodiments, the air venting device is a conventional float based air venting device in which the float controls opening and closing of a venting valve through which air is vented out to the surroundings.

Figure 2:
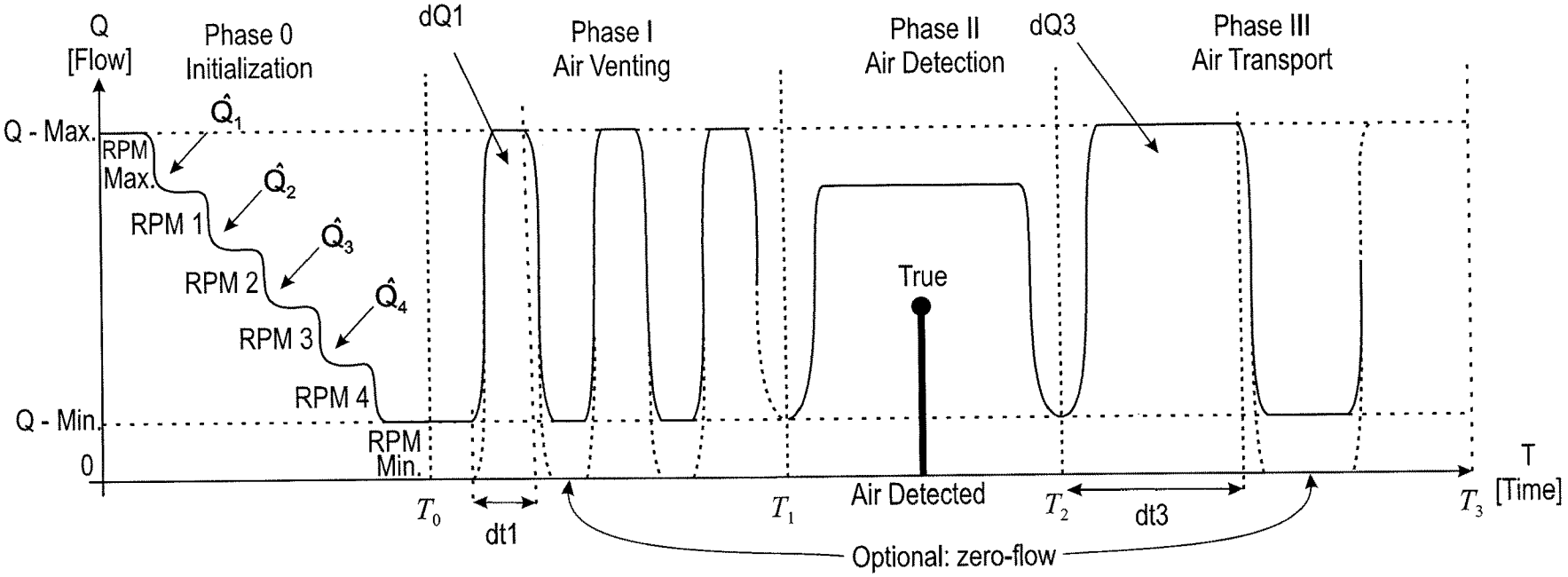
FIG. 2 is a graph schematically illustrates three phases carried out in preferred embodiment

Reference is now made to FIG. 2 schematically illustrating a preferred embodiment of a method of venting air out of a closed fluid system 1. As illustrated, the preferred embodiment comprising three phases a first phase P1, a second phase P2 and a third phase P3. It to be emphasised that although FIG. 2 illustrates the three phase as consecutive in the order P1→P2→P3, the invention is not limited to such consecutive ordering of the phases as other ordering of the phases such as P2→P3→P1, or even P1→P3→P2. Accordingly, any permutation of the order of the phases are considered to be within the present invention. FIG. 2 also illustrated an optional zero phase detailed below.

Further, although FIG. 2 only discloses a single cycle of executing the three phases P1→P2→P3, a number of cycles is typically preferred, that is in preferred embodiments, the method may be carried out e.g. as P1→P2→P3→P1→P2→P3→P1 . . . . A cycle is represented by an execution of the three phases, either in the sequence illustrated in FIG. 2 or a permutation thereof.

It is noted that FIG. 2 is drawn based on volume flow Q over time t. However, as presented herein, a value for the volume flow may not be needed as the flow typically is controlled by the controlling the rotational speed of the pump 3. Under ideal conditions, where the hydraulic response time is essentially zero, the rotational speed and the volume flow is correlated without a time delay whereby the volume flow shown in FIG. 2 could be "replaced" by rotational speed of the pump 3. However, in many closed loop systems the hydraulic response time is different from zero. Accordingly, if FIG. 2 is drawn based on rotational speed and taking the hydraulic response time into account, the progression of volume flow would resemble the progression shown in FIG. 2 although time-wise shifted due to the non-zero hydraulic response time.

In preferred embodiments, the second phase P2 may be set to be executed recursively for a number of times, without carrying out the first and/or third phase. As an example, the second phase P2 is executed recursively for a number of times prior to executing the first and the third phase. The purpose of such recursively execution of the second phase is to await air detection before the first and third phase are executed. By this, the second phase is executed recursively and when air is detected, the recursive execution is abandoned and the first and third phases P1, P3 are executed. Following these first and third phases P1, P3, one or more of cycles of executing P1→P2→P3 (or a permutation thereof) may preferably carried out. When no air is detected, the recursive execution of the second phase P2 may be resumed. It is noted, that a consecutive second phase in the recursive execution of the second phases may preferably be carried out with a time delay, during which the closed fluid system is running in normal operation, that is where a method of venting air out is not carried out. Such a time delay may be in the order of minutes, hours or even days. The number of times the second phase is executed recursively is typically empirically determined.

In preferred embodiments, the execution of the cycles is preferably stopped when a predefined criteria has been met. A preferred embodiment of such a predefined criteria comprises stopping after a time-out has been reach or after no air detected. In further embodiments, the predefined criteria comprising stopping execution of the cycles after the first occurring event of time-out has been reached or no air detection has become true. Here "stopped" refers to at least two situations, where a first situation is where no more cycles are carried out, or that a number of cycles such as two or three cycles are carried out before no more cycles are carried out. No more cycles does not mean that the method will not be invoked again at a later stage, but refers to a time-mark where the method is said to be temporarily completed.

The different phases are typically effectuated by operating said pump 3, which typically involves setting the speed of the pump 3, to effectuate:

- the first phase P1, wherein the pump 3 is operated to provide a number of first flow pulses dQ1 in the fluid system 1 each having a pulse width dt1 being shorter than a first pulse width,
- the second phase P2, during which air, if present in said fluid, is detected, and
- the third phase P3, wherein the pump 3 is operated to provide a number of third flow pulses dQ3 in the fluid system 1 each having a pulse width dt3 being longer than said first pulse width.

As illustrated in FIG. 2, the flow pulse dQ1 spans a time period starting where the volume flow is increased and ending where the volume flow is decreased to the volume flow before being increased. However, the invention is not limited to the flow after the flow pulse dQ1 is the same as before increase. Accordingly, the spanned time period is referred to as the pulse width dt1. The flow pulse dQ3 and pulse width dt3 are defined in the same manner as disclosed in FIG. 2.

In between flow pulses, the volume flow is typically maintained at a constant level, which might be zero volume flow as will detailed below.

The length of various pulse widths applied are typically determined through experiments and set by a user, in accordance with that each of the phases is designed with the purpose to handle different scenarios for venting air out.

In a closed fluid system some air accumulation may occur in regions of the flow system where the flow of fluid either cannot move the air accumulation or the movement is relatively slow compared to the flow of water. The inventors have realised that by pulsing flow as in the first phase P1, there is a higher possibility to loosen such air accumulations in regions where a prolonged constant flow very slowly or even not loosen such air accumulations. The process may be thought of "knocking loose air pockets". The number of pulses and the duration may depend on a specific layout of the closed fluid system, and may accordingly be determined by experiments. However, in preferred embodiment of the invention such parameters are determined a priori e.g. based on previous experiments carried in one or more closed fluid system.

The second phase is designed to detect air in the closed fluid system 1. As will be disclosed below numerous ways to detect air is found useable in connection with the present invention. However, the second phase may be used in a decision as to whether or not there is a need to venting air out. Needless to say, if no air is present, there is no need to vent air out. However, air may enter into fluid system over time, e.g. due to service of the fluid system where fluid is added to the system, whereby the method according to the invention may need to be carried out on a regular basis. Further, as air detection in some embodiments is restricted to detecting at one or more locations in the fluid system, air may be present at other locations in the fluid system.

The third phase is designed to transport air around in the fluid system and typically toward the location of the air venting device 4. As shown in FIG. 2 the pulse width in the third phase, dt3, is longer than the pulse width in the first phase, dt1, due to the different purposes, where the first phase P1 aims at loosen air accumulations, whereas the second phase aims at transporting air.

The first pulse width, although having an arbitrary width in the sense that the pulse width in the first phase should be shorter and the third pulse width should be longer than the first pulse width, the length of the first pulse width may be estimated in the following manner. The longest pipes extending vertically with a downward flow is identified and the maximum volume downward during the third phase P3 is calculated (e.g. based on the pump speed). The velocity of an air accumulation moving upward through the identified pipe under e.g. no flow conditions is calculated. The length of the first pulse is then determined so that under the given maximum volume flow during the third phase P3, the upwards going motion of the air accumulation is outbalanced by the volume flow so that the volume flow, at least theoretically, will be moved out of the selected pipe at an lower end thereof.

As illustrated in FIG. 2, preferred embodiments of the invention comprises that pump 3 in the phase P2 is operated to provide a non-pulsed, such as constant, flow in said fluid system 1. This may be beneficial as air detection may be influenced by changes, such as rapid changes, in the speed of the pump 3, such as by introducing cavitation in the impeller. The duration of the non-pulsed period is preferably longer than said first pulse width, as this will increase the possibility of air accumulation(s) is(are) transported to the position(s) where air detections takes place.

A preferred way of detecting air involves the pump 3. It has been found that when air passes through a pump, the pump due to a less dense fluid requires less power to operate. As a result of this, the pump 3 often responds to presence of air by increasing the rotational speed of the pump 3 and/or by reducing its power consumption. Thus, in preferred embodiments, air detection comprising detecting a step up in a rotational speed of said pump 3 and/or a step down in power consumption of said pump 3. It is noted that a "step" in this regard, not necessarily is a square ramp-up or square ramp-down, as inertia in the system will provide a gradual ramp-up and gradual ramp-down, although clearly identifiable over minor fluctuations that normally occur in speed and power.

While air detection based on the power and/or rotational speed of the pump has been found to be a good possibility for air detection, other air detection device may be used either in combination with or without the use of the pump 3 for air detection. Such devices may be a sensor determining density of the fluid flowing in the closed loop system (air present in the fluid will in general lower the density of the fluid), a sensor sensing the heat capacity, such as a hot-wire, of the fluid (air present in the fluid will in general lower the heat capacity), or other sensor types configured to detect air in the fluid.

As illustrated in FIG. 2, the volume flow in one or more such as all of the first flow pulses dQ1, and the volume flow in one or more such as all of said third flow pulses dQ3 increases from a first volume flow Q1 to a second volume flow Q2 and subsequently decreases the second volume flow to said first volume Q1.

Alternatively, the subsequent decrease may be to a third volume flow Q3 being smaller than the second volume flow Q2 but different from the first volume flow Q1, such as larger than or smaller than the first volume flow to introduce e.g. a higher dynamicity in the flow.

The pump 3 and the closed fluid system may impose certain limitation on maximum and minimum volume flows. For instance, a maximum volume flow may be the maximum volume flow the pump 3 can produce, or it may a maximum volume flow allowed in the closed fluid system, such as due to noise or other factors to consider. Similarly, the minimum flow may be restricted to be different from zero flow, which may be important e.g. due to the risk of damaging e.g. a boiler which typically requires a minimum volume flow through it to avoid overheating of components within the boiler. In accordance with this, preferred embodiments comprise that the first volume flow Q1 is a preselected minimum volume flow Qmin and said second volume flow Q2 is a preselected maximum volume flow Qmax. Such preselected volume flows are typically defined by a technician with knowledge about the closed fluid system and component requirements. In some embodiments, the actual values of the minimum and/or maximum volume flow is/are not known or even not needed due to the following reasoning. The volume flow in the closed fluid system is correlated with the rotational speed of the pump 3, and the a maximum volume flow may e.g. be that volume flow which can be provided by the pump 3 operating at e.g. a maximum rotational speed. Similarly, a minimum volume flow may e.g. be determined as the rotational speed of the pump 3 where a volume flow occurs or a substantial volume flow occurs.

In some preferred embodiments, a rate of change (dQ/dt) of volume flow during said increase is imposed by changing the rotational speed of the pump 3 providing said fist volume flow to the rotational speed providing said second volume flow over a time period being larger than 1 ms and preferably smaller than 5 seconds, such as smaller than 3 seconds, preferably smaller than 1 second.

In some preferred embodiments, an absolute value of a rate of change (dQ/dt) of volume flow during said decrease is imposed by changing the rotational speed of the pump (3) from the rotational speed providing said second volume flow to the rotational speed providing said second volume flow or said third volume flow over a time period being larger than 1 ms and preferably smaller than 5 seconds, such as smaller than 3 seconds, preferably smaller than 1 second.

It is noted, that the inertia in the system often introduces a response delay, also referred to as a hydraulic response time, in the sense that even if the pump has reached e.g. the rotational speed which should provide the second volume flow, it may takes some time before the flow has settled to provide the second volume flow. Similar, a response delay may be present when the volume flow is decreased.

In some preferred embodiments, one or more such as all of said pulses comprises a time period with constant volume flow immediately after the volume flow has increased to a second volume flow Q2 being larger than the first volume flow Q1. By including a time period with constant volume flow, the flow in closed fluid system typically has sufficient time to settle into a stable flow before the flow is decreased. In addition, in the second phase, the constant high volume flow may increase the possibility that air accumulation will be present at the location where air detection takes place. In the third phase, the constant high volume flow may increase the possibility that air accumulation is transported towards the air venting device 4.

It is to be emphasized that although preferred embodiments of the invention has been disclosed in terms of volume flow, knowledge of the volume flow may be omitted. There is a relationship between volume flow and rotational speed whereby the variable speed pump 3 may be operated based only on the rotational speed, to produce the desired flow pulses without determining an actual volume flow.

Reference is made to FIG. 2. As illustrated in this figure, preferred embodiments may comprise what may be referred to as an zero phase P0, typically being an initialization step. During such a zero phase P0, the rotational speed of said variable speed pump 3 is ramped-up and/or ramped-down in-between a maximum rotational speed $RPM_{max}$ and a minimum rotational speed $RPM_{min}$ during which the volume flow through said variable speed pump may be recorded. In the embodiment shown in FIG. 2, the rotational speed is ramped-down in a stepwise manner, but the ramp-up or ramp-down may be done differently such a constant ramp-down or ramp-up.

Such a zero phase typically serves the purpose of investigating flow or RPM limits for the closed flow system, such that one or more a subsequently phases are carried out within such flow or RPM limits. It is worth noting that such a zero phase does not need to be carried out prior to carrying out a sequence comprising one or more of first phase P1, second phase P2 and third phase P3. The zero phase could for instance be limited to be carried out after the closed flow system is put into service either for the first time or after service has been carried out to the closed flow system.

It is however, noted that the zero phase may be omitted, e.g. due to a prior knowledge of the rotational speed and/or volume flow applicable for the pump 3.

Preferred embodiments of the method according to the invention is computer implemented. Such implementation utilises a processor 7 being configured to control the rotational speed of said pump 3 to carry out the first phase P1, the second phase P2, the third phase P3 and the optional zero phase P0. Such controlling typically involves that the processor acts based on a set of software instructions designed to operate the pump (3) to provide the various pulses. As disclosed above, a preferred variable speed pump (3) has an electrical circuit controlling the rotational speed of the impeller and in computer implemented embodiments, the circuit has an interface configured to received control signals from the controller 7.

The controller 7 is preferably also configured to determine the step up in a rotational speed of said pump 3 and/or the step down in power consumption of said pump 3, thereby detecting air present in the pump 3. This is typically implemented by the controller 7 receives a speed signal from the pump 3 representing the actual speed of the pump 3 and/or a power signal representing the actual consumption of the pump 3. Such signals are typically provided by sensors. The processor 7 evaluates the received signal(s) over time and if a step-up in rotational speed and/or step-down in power consumption is/are detected, the controller 7 decide that air is present in the pump 3. Such decision can be used to evaluate whether or not to continue with the venting method as if no air is detected, it may be decide to stop or postpone a further venting.

The controller 7 may be a controller located in a distance from the pump or may be located within a housing of the pump 3. The latter is particular useful as such controllers 7 typically comprises an interface accessible for downloading software instructions to the controller, whereby a variable speed pump 3 easily can be provided with software instructions allowing it to carry out an embodiment of venting air according to the invention.

The individual elements of an embodiment of the invention may be physically, functionally and logically implemented in any suitable way such as in a single unit, in a plurality of units or as part of separate functional units. The invention may be implemented in a single unit, or be both physically and functionally distributed between different units and processors.

ITEMIZED LIST OF PREFERRED EMBODIMENTS

Item 1. A method of venting air out of a closed fluid system (1) comprising a number of inter connected pipes (2) configured for flow of a fluid, a variable speed pump (3) configured for controlling the volume flow of fluid in said fluid system (1) and an air venting device (4) configured to let air out from the fluid system, the method comprising operating said pump (3) in at least three phases, wherein in a first phase (P1), said pump (3) is operated to provide a number of first flow pulses (dQ1) in said fluid system (1) each having a pulse width (dt1) being shorter than a first pulse width, in a second phase (P2), during which air, if present in said fluid, is detected, and in a third phase (P3), said pump (3) is operated to provide a number of third flow pulses (dQ3) in said fluid system (1) each having a pulse width (dt3) being longer than said first pulse width.

Item 2. A method according to item 1, wherein said pump (3) in the second phase (P2) is operated to provide a non-pulsed, such as constant, flow in said fluid system (1) during a time period being longer than said first pulse width, Item 3. A method according to item 1 or 2, wherein said air detecting comprising detecting a step up in a rotational speed of said pump (3) and/or a step down in power consumption of said pump (3).

Item 4. A method according to any one of the preceding items, wherein the volume flow in one or more such as all of said first flow pulses (dQ1) and wherein the volume flow in one or more such as all of said third flow pulses (dQ3) increases from a first volume flow (Q1) to a second volume flow (Q2) and subsequently decreases the second volume flow to said first volume (Q1) or to a third volume flow (Q3).

Item 5. A method according to item 4, wherein said first volume flow (Q1) is a preselected minimum volume flow (Qmin) and said second volume flow (Q2) is a preselected maximum volume flow (Qmax).

Item 6. A method according to item 4 or 5, wherein a rate of change (dQ/dt) of volume flow during said increase is imposed by changing the rotational speed of the pump (3) from the rotational speed providing said fist volume flow to the rotational speed providing said second volume flow over a time period being larger than 1 ms and preferably smaller than 5 seconds, such as smaller than 3 seconds, preferably smaller than 1 second.

Item 7. A method according to any one of items 4-6, wherein an absolute value of a rate of change (dQ/dt) of volume flow during said decrease is imposed by changing the rotational speed of the pump (3) from the rotational speed providing said second volume flow to the rotational speed providing said first volume flow or said third volume flow over a time period being larger than 1 ms and preferably smaller than 5 seconds, such as smaller than 3 seconds, preferably smaller than 1 second.

Item 8. A method according to any one of items 4-7, where one or more such as all of said pulses comprises a time period with constant volume flow immediately after the volume flow has increased to said second volume flow (Q2).

Item 9. A method according to any one of the preceding items, further comprising an zero phase (P0), during which the rotational speed of said variable speed pump (3) is ramped-up and/or ramped-down in-between a maximum rotational speed ($RPM_{max}$) and a minimum rotational speed ($RPM_{min}$) during which the volume flow through said variable speed pump is recorded.

Item 10. A method according to any one of the preceding items, wherein the second phase is executed recursively for a number of times prior to executing said first and said third phase.

Item 11. A method according to any one of the preceding items, wherein said first, second and third phases are executed in cycles, and wherein the execution of said cycles is stopped when a predefined criteria has been met.

Item 12. A method according to any one of the preceding items, wherein the method is computer implemented and utilises a processor (7) configured to control the rotational speed of said pump (3) to carry out said first phase (P1), said second phase (P2) and said third phase (P3).

Item 13. A method according item 13, when dependent on item 3, wherein the processor (7) is further configured to determine said step up in a rotational speed of said pump (3) and/or said step down in power consumption of said pump (3), thereby detecting air present in the pump (3).

Item 14. A method according to item 14, wherein said processor (7) is located within a housing of said pump (3).

Item 15. A closed fluid system (1) comprising a number of inter connected pipes (2) configured for flow of a fluid, a variable speed pump (3) configured for controlling the volume flow of fluid in said fluid system (1) and an air venting device (4) configured to let air out from the fluid system, wherein said closed fluid system comprising a processor (7) configured to carry out the method according to any one of the preceding items.

Although the present invention has been described in connection with the specified embodiments, it should not be construed as being in any way limited to the presented examples. The scope of the present invention is to be interpreted in the light of the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

LIST OF REFERENCE SYMBOLS USED

1 Fluid system
2 Pipe
3 Pump
4 Air venting device
5 Radiator
6 Boiler
7 Processor
g Gravity
P0 Zero phase
P1 First phase
P2 Second phase
P3 Third phase
dQ1 First flow pulses
dQ3 Third flow pulses
dt1 Pulse width in first phase
dt3 Pulse width in second phase

The invention claimed is:

1. A method of venting air out of a closed fluid system, the closed fluid system including a number of inter connected pipes configured for flow of a fluid, a variable speed pump configured for controlling the volume flow of fluid in said fluid system by varying a rotational speed of the pump and an air venting device configured to let air out from the fluid system, the method comprising:

operating said pump in at least three phases, wherein:

in a first phase, said variable speed pump is operated by varying the rotational speed of the pump to provide a number of first flow pulses in said fluid system each having a pulse width being shorter than a first pulse width;

in a second phase, during which air, if present in said fluid, is detected; and in a third phase, said variable speed pump is operated by varying the rotational speed of the pump to provide a number of third flow pulses in said fluid system each having a pulse width being longer than said first pulse width.

2. A method according to claim 1, wherein said variable speed pump in the second phase is operated to provide a non-pulsed flow in said fluid system during a time period being longer than said first pulse width.

3. A method according to claim 2, wherein the non-pulsed flow is a constant flow.

4. A method according to claim 3, wherein during operation of said pump in said second phase, further comprising:

detecting a step up in the rotational speed of said variable speed pump and/or a step down in power consumption of said variable speed pump.

5. A method according to claim 2, wherein during operation of said pump in said second phase, further comprising:

detecting a step up in the rotational speed of said variable speed pump and/or a step down in power consumption of said variable speed pump.

6. A method according to claim 1, wherein during operation of said pump in said second phase, further comprising:

detecting a step up in the rotational speed of said variable speed pump and/or a step down in power consumption of said variable speed pump.

7. A method according to claim 6, wherein the method is computer implemented and includes a processor configured to control the rotational speed of said variable speed pump to carry out said first phase, said second phase, and said third phase.

8. A method according to claim 1, wherein the volume flow in one or more of said first flow pulses and wherein the volume flow in one or more of said third flow pulses increases from a first volume flow to a second volume flow and subsequently decreases the second volume flow to said first volume or to a third volume flow.

9. A method according to claim 8, wherein said first volume flow is a preselected minimum volume flow and said second volume flow is a preselected maximum volume flow.

10. A method according to claim 8, wherein a rate of change of volume flow during said increase is imposed by changing the rotational speed of the variable speed pump from the rotational speed providing said first volume flow to the rotational speed providing said second volume flow over a time period being larger than 1 ms.

11. A method according to claim 10, wherein said changing the rotational speed of the variable speed pump from the rotational speed providing said first volume flow to the rotational speed providing said second volume flow over a time period being smaller than 5 seconds.

12. A method according to claim 8, where one or more of said pulses comprises a time period with constant volume flow immediately after the volume flow has increased to said second volume flow.

13. A method according to claim 8, wherein an absolute value of a rate of change of volume flow during said decrease is imposed by changing the rotational speed of the pump from the rotational speed providing said second volume flow to the rotational speed providing said second volume flow or said third volume flow over a time period being larger than 1 ms.

14. A method according to claim 1, wherein the second phase is executed recursively for a number of times prior to executing said first and said third phase.

15. A method according to claim 1, wherein said first, second and third phases are executed in cycles, and wherein the execution of said cycles is stopped when a predefined criteria has been met.

16. A closed fluid system comprising a number of inter connected pipes configured for flow of a fluid, a variable speed pump configured for controlling the volume flow of fluid in said fluid system and an air venting device configured to let air out from the fluid system, wherein said closed fluid system comprising a processor configured to carry out the method according to claim 1.

17. A method according to claim 1, further comprising:

a zero phase, during which the rotational speed of said variable speed pump is ramped-up and/or ramped-down in-between a maximum rotational speed and a minimum rotational speed during which the volume flow through said variable speed pump is recorded.

18. A method according to claim 1, wherein the method is computer implemented and includes a processor configured to control the rotational speed of said variable speed pump to carry out said first phase, said second phase, and said third phase.

19. A method according claim 18, wherein during operation of said pump in said second phase the processor is further configured to determine a step up in a rotational speed of said variable speed pump and/or a step down in power consumption of said variable speed pump, thereby detecting air present in the variable speed pump.

20. A method according to claim 18, wherein said processor is located within a housing of said pump.

* * * * *